US005256936A

United States Patent [19]

Itoh et al.

[11] Patent Number: 5,256,936

[45] Date of Patent: Oct. 26, 1993

[54] IMAGE DISPLAY DEVICE

[75] Inventors: Shigeo Itoh; Teruo Watanabe; Hisashi Nakata; Norio Nishimura, all of Mobara; Junji Itoh; Seigo Kanemaru, both of Tsukuba, all of Japan

[73] Assignee: Futaba Denshi Kogyo K.K., Mobara, Japan

[21] Appl. No.: 766,071

[22] Filed: Sep. 27, 1991

[30] Foreign Application Priority Data

Sep. 27, 1990 [JP] Japan ..... 2-255054

[51] Int. Cl.[5] ..... H01J 17/49

[52] U.S. Cl. ..... 313/495; 313/308; 313/309

[58] Field of Search ..... 313/495, 422, 308, 309

[56] References Cited

U.S. PATENT DOCUMENTS 3,701,919 10/1972 Geppert ..... 313/308 X 5,053,673 10/1991 Tomii et al. ..... 313/308

FOREIGN PATENT DOCUMENTS 0072348 5/1980 Japan ..... 313/495

*Primary Examiner*—Palmer C. DeMeo

*Attorney, Agent, or Firm*—Oblon, Spivak, McClelland, Maier & Neustadt

[57] ABSTRACT

An image display device capable of minutely setting the interval between an emitter (6) and a gate (5) with high accuracy and of being driven at a significantly reduced drive voltage with good emission uniformity. Each emitter (6) is provided in a recess in a substrate (2), so that the interval between the emitter (6) and a gate (5) is determined depending upon the thickness of the emitter (6). Thus, the interval can be readily controlled by adjusting or varying the period of time during which the film for the emitter (6) is formed, resulting in a micro-interval of the order of sub-microns between the two components being possible with high accuracy.

5 Claims, 5 Drawing Sheets

IMAGE DISPLAY DEVICE

BACKGROUND OF THE INVENTION

This invention relates to an image display device for displaying a projected image, a graphic or the like, and more particularly to an image display device using an electron source of the field emission type.

A conventional image display device using a field emission element is generally constructed as shown in FIGS. 9 and 10, and as proposed by the assignee in Japanese Patent Application No. 78453/1990. The conventional image display device includes an insulating glass substrate 101 serving as a first substrate, on which a plurality of strip-like anodes 102 are located extending continuously in the x direction. The anodes 102 are arranged in a manner to be in parallel with one another at predetermined intervals in the y direction perpendicular to the x direction.

Also, the image display device includes an insulating layer 103 deposited on the substrate 101 so as to cover the anodes 102. The insulating layer 103 may be made of any suitable material such as $SiO_2$, SiN, a mixture of $SiO_2$ and $Al_2O_3$, or the like. The insulating layer 103 is formed at portions corresponding to the anodes 102 with through-holes 104, which are separated from each other at predetermined spaces or intervals. Phosphor layers 105 are located at the through-holes 104 in a dot-like arrangement. These phosphor layers 105 are electrically connected via their corresponding through-holes 104 to the anodes 102, resulting in the formation of dots which constitute a display plane.

Field emitters 106 are arranged on the insulating layer 103 adjacent to the respective phosphor layers 105. Each of the field emitters 106 includes a pectinate section 107 formed into a pectinate shape by etching. A plurality of the field emitters are connected in common to each other in every row in the Y direction, so that a plurality of field emitter arrays 108 are formed. The plural field emitter arrays 108 so-formed are arranged in parallel with each other at predetermined intervals in the x direction, resulting in a field emitter group 109 being formed as a whole. A gate electrode 110 is arranged on the insulating layer 103 between each of the field emitters 106 and each of the phosphors 105. The gate electrodes 110 are connected in common to each other in every row in the y direction, so that a plurality of gate electrode arrays are defined in parallel with one another in the x direction.

A lid-like casing 113 is mounted and sealed on the glass substrate 101. The casing has side plates 111 and a rear cover or plate 112, and cooperates with the substrate 101 to form an air-tight envelope 114 with a box-like shape, which is then evacuated to a high vacuum. All over the inner surface of the rear cover 112 is deposited a back electrode 115 to which a positive potential is applied to direct or deflect a stream of electrons emitted from the field emitters 106 towards the rear plate 112.

As will be noted from the foregoing, the conventional image display device using the field emitting element is so constructed that the gate electrodes 110 and phosphor layers 105 are formed on the same plane. Unfortunately, such a construction results in the distance or interval between the respective electrodes to be determined depending upon the accuracy of the lithographic processing in etching by exposure, so that it is very difficult for the image display device to produce a display at high density.

SUMMARY OF THE INVENTION

The present invention has been made in view of the foregoing disadvantage of the prior art.

Accordingly, it is an object of the present invention to provide an image display device which is capable of being operated at a significantly reduced drive voltage.

It is another object of the present invention to provide an image display device which is capable of minutely controlling the interval between the emitter and gate in increments of the order of sub-microns.

It is a further object of the present invention to provide an image display device which is capable of exhibiting increased electric field strength, improved durability and good emission uniformity.

In accordance with the present invention, there is provided an image display device comprising: a first substrate formed with a plurality of recesses; a plurality of emitters provided in the recesses, each emitter being rectangular in shape; a gate provided at the periphery of each emitter on the first substrate; a second substrate forming a vacuum envelope in cooperation with the first substrate; and an anode phosphor combination laminated onto the second substrate at a position opposite to the emitters.

BRIEF DESCRIPTION OF THE DRAWINGS

The invention may be carried into practice in various ways and some embodiments will now be described by way of example with reference to the accompanying drawings, in which.

DETAILED DESCRIPTION OF THE PREFERRED EMBODIMENTS

Figure 1:
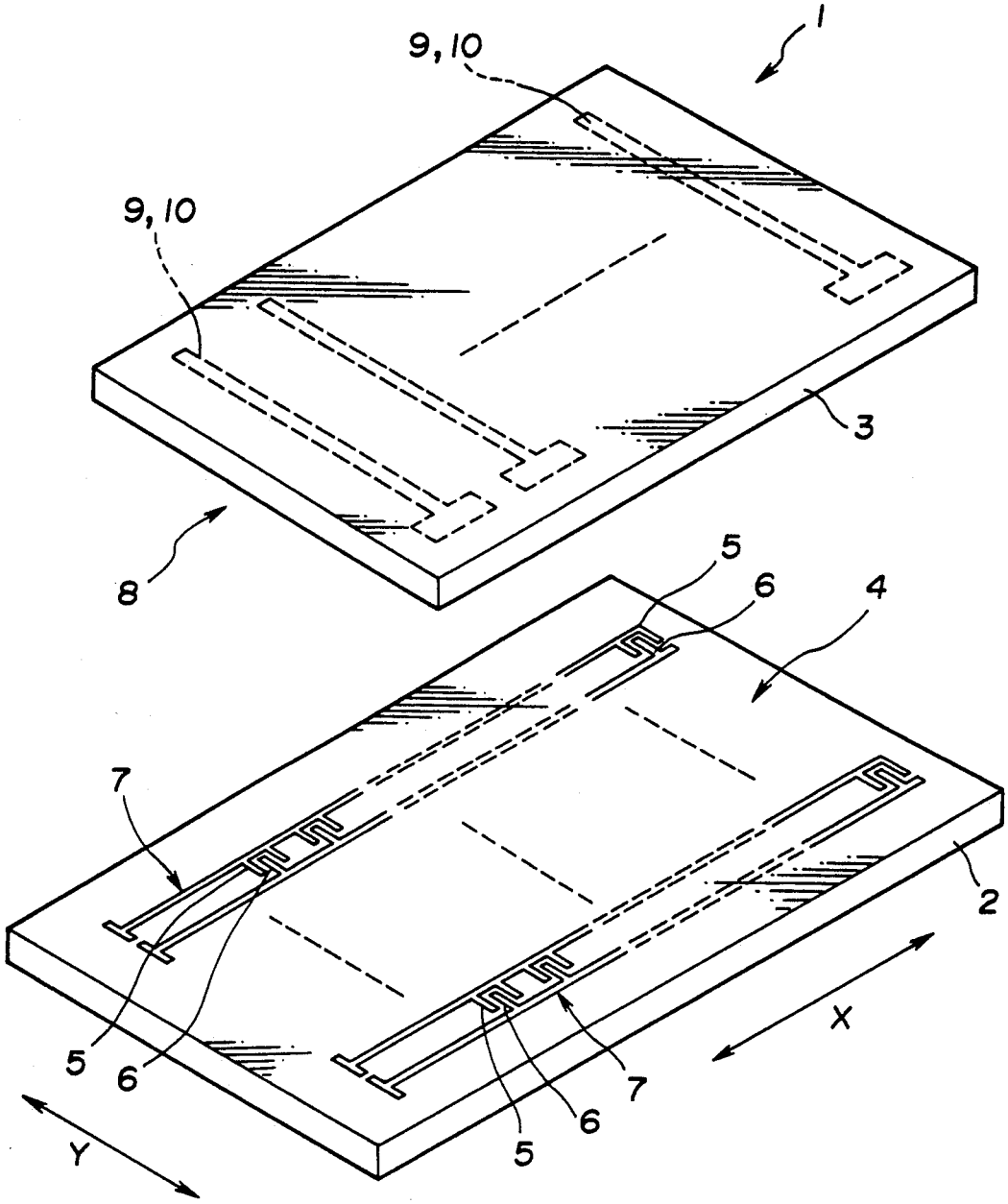
FIG. 1 is an exploded perspective view showing an essential part of a first embodiment of an image display device according to the present invention.

Referring first to FIGS. 1 to 6, illustrating a first embodiment of the present invention, an image display device 1 includes a first substrate 2 and a second substrate 3 arranged in parallel with each other at a predetermined interval. Side plates (not shown) are located between the outer periphery of the first substrate 2 and that of the second substrate 3, resulting in a box-like envelope being formed, which is then evacuated to high vacuum.

An electron emission section 4 is formed on the inner surface of the first substrate 2. In the illustrated embodiment, the electron emission section 4 includes a plurality of electron emission arrays 7 each comprising a plurality of gates 5 arranged in every row in an x direction and connected in common to each other and a plurality of emitters 6 arranged in every row in the x direction so as to correspond to the gates 5 and connected in common to each other. The electron emission arrays 7 are arranged in parallel with each other in a y direction perpendicular to the x direction. In each combination or set of the gate 5 and emitter 6 in each of the electron emission arrays 7, as described in more detail below, the gate 5 is formed into a substantially U-shaped pattern and the first substrate 2 is formed with a recess in that portion of its inner surface which is surrounded by each of the U-shaped gates 5. Each of the emitters 6 forming the combination or set in co-operation with each of the gates 5 is formed into a rectangular shape and is located in the recess.

The image display device of the illustrated embodiment also includes a luminous display section 8 on a portion of the inner surface of the second substrate 3 opposite to the electron emission section 4 on the first substrate 2. The luminous emission section 8 comprises a plurality of strip-like anodes which are arranged side by side at suitable intervals in the x direction, each having a phosphor 10 deposited thereon.

The construction and manufacture of the electron emission section 4 formed on the first substrate 2 will now be described in detail with reference to FIGS. 2 to 6. The following description will address only one set or combination of the gate 5 and emitter 6, for the sake of brevity.

Figure 2:
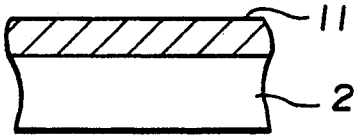
FIGS. 2, 3(*a*) and 3(*b*), 4, 5(*a*) and 5(*b*), and 6 are successive schematic sectional views showing steps in the manufacture of the electron emission section in the image display device of FIG. 1.

First, as shown in FIG. 2, a layer 11 of metal such as Al, W or the like for the gates is deposited on the insulating substrate 2 made of $SiO_2$ or the like.

Figure 3B:
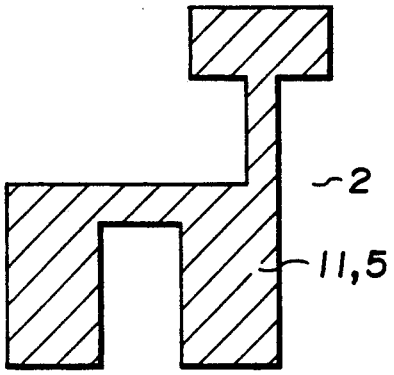
Figure 3A:
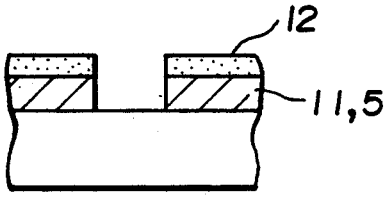

Then, as shown in FIGS. 3(*a*) and 3(*b*), a resist 12 of a predetermined pattern is formed on the metal layer 11 and is subjected to etching by RIE techniques or the like, to produce the U-shaped gate 5.

Figure 4:
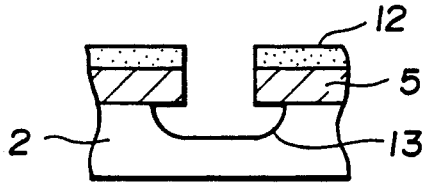

Subsequently, as shown in FIG. 4, the portion of the upper surface of the substrate 2 which is not covered with the gate 5 is subjected to wet etching, resulting in a recess 13 being formed.

Figure 5B:
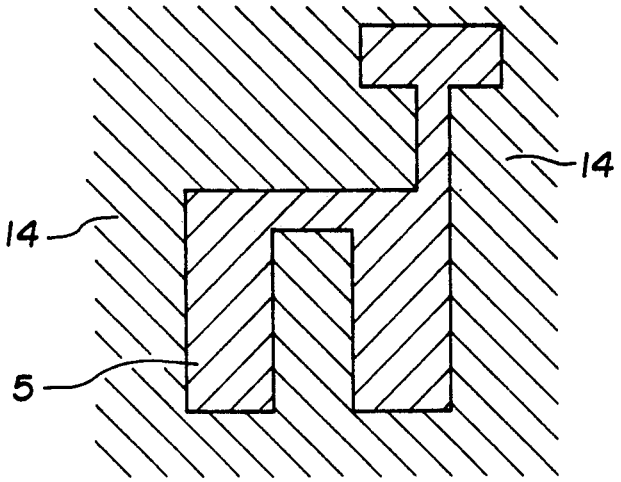
Figure 5A:
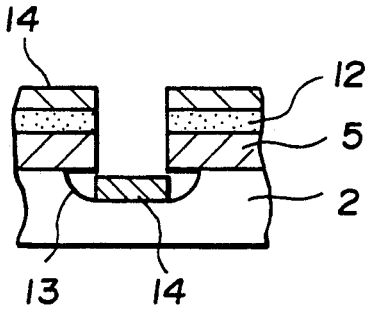

Thereafter, as shown in FIGS. 5(*a*) and 5(*b*), an emitter layer 14 is formed in the recess 13. The emitter layer comprises a base made of metal such as Mo, W, Al or the like, or metal such as Ti, Al or the like with a compound semiconductor made of LaB6 and deposited on it.

Figure 6:
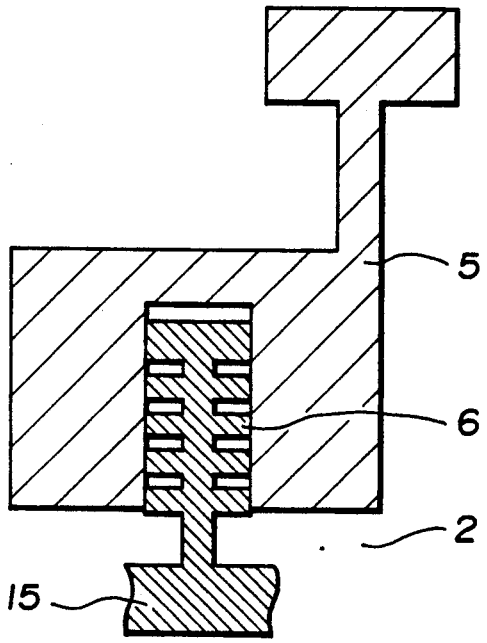

Finally, as shown in FIG. 6, unnecessary portions of the emitter layer 14 are removed to form the emitter 6 surrounded by the U-shaped gate 5, and also a lead 15 connected to and leading out from the emitter 6.

The manner of operation of the image display device 1 of the first embodiment will now be described.

Firstly, the application of a positive voltage to the desired gates 5 permits electrons to be emitted from the emitters 6 surrounded by the gates. Then, when a positive voltage is applied, at a suitable timing, to the anodes 9 arranged on the second substrate 3 opposite to the emitters 6, the electrons emitted from emitters 6 are caused to impinge on the anodes 9 so that the phosphors 10 may be excited to emit light resulting in the desired luminous display being exhibited.

In the illustrated embodiment, the space or interval between each of the emitters 6 and each of the gates 5 on the first substrate 2 is determined in dependence upon the thickness of the emitters 6. The thickness of the emitter 6 formed in the recesses 13 can be controlled by adjusting or varying the period of time during which the metal film for the emitters 6 is deposited, so that the interval may be set or determined with very high accuracy. This results in a three-dimensional structure and method of manufacturing of the image display device in which the interval between the electrodes 5 and 6 can be minutely set with high accuracy as compared with the conventional image display device of a rather two-dimensional structure in which the emitters and gates are arranged in the same plane. Thus, the illustrated embodiment permits the drive voltage to be significantly decreased and the electron emission section to be highly densified.

In this embodiment, the anodes 9, which function as the luminous display section, are each formed into a strip-like shape. However, the present invention may be embodied in such a manner that the anode is formed all over the whole of the inner surface of the second substrate 3; one phosphor is deposited on the anode, or three phosphors respectively having luminous colours red, green and blue are deposited separately from each other on the anodes; and the emitters and gates are arranged in a matrix-like form on the first substrate through an insulating layer. In this way, matrix driving of the emitters and gates permits a desired portion of the anode to emit light selectively.

Figure 7:
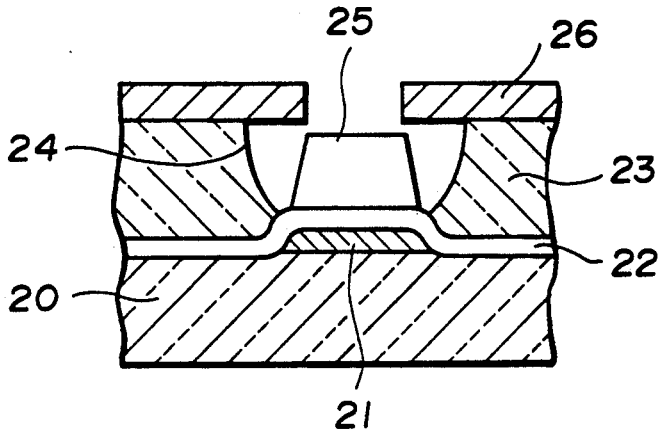
FIG. 7 is a sectional view showing an essential part of a second embodiment of an image display device according to the present invention.
Figure 8:
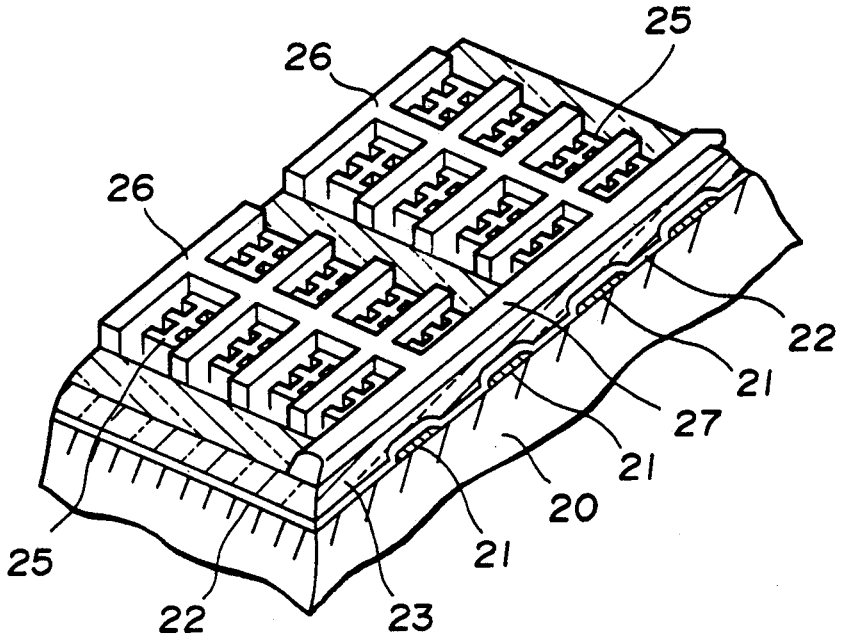
FIG. 8 is a fragmentary perspective view showing an essential part of the image display device shown in FIG. 7.
Figure 9:
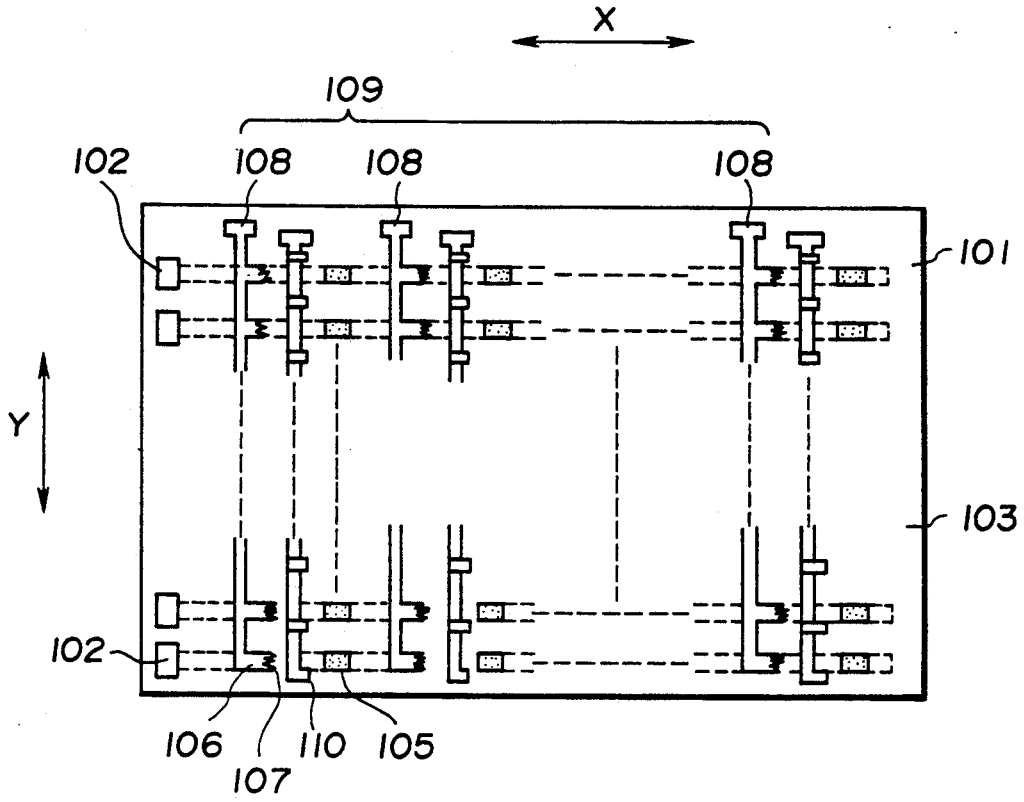
FIG. 9 (PRIOR ART)
FIG. 9 is a plan view showing an essential part of a conventional image display device.
Figure 10:
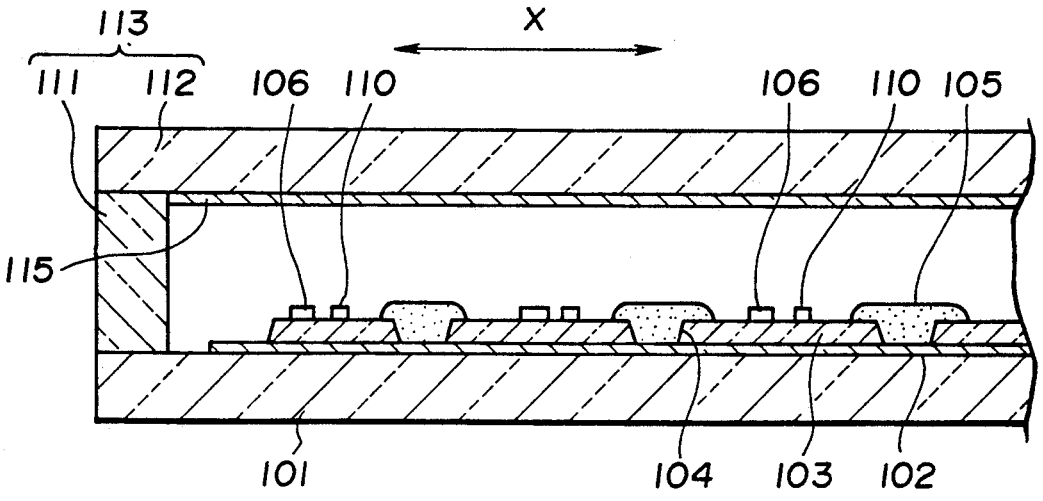
FIG. 10 (PRIOR ART)
FIG. 10 is a sectional view of the conventional image display device shown in FIG. 9.

FIGS. 7 and 8 show a second embodiment of an image display device according to the present invention, in which the gates and emitters are arranged in such a matrix-like form, as briefly described below.

The image display device of the second embodiment includes a first substrate 20, on which strip-like emitter wirings 21 made of indium-tin oxide (ITO), Al or the like are arranged side by side at predetermined intervals. A resistance layer 22 formed by doping polysilicon with P, B or the like, and an insulating layer 23 are deposited in order in a laminar form on the emitter wirings 21. The insulating layer 23 is formed with recesses 24 in which the emitters 25 are arranged, the emitters 25 then being connected to the emitter wirings 21. Gates 26 are provided on the insulating layer 23, the gates 26 being connected to gate wirings 27 arranged on the insulating layer so as to extend in a direction perpendicular to the emitter wirings 21.

The construction of this second embodiment may be achieved by forming the emitter wirings 21 on the first substrate 20 and then forming the resistance layer 22 ($10^5$ to $10^6$ ohm cm) all over the first substrate 20. Then, the insulating layer 23 of $SiO_2$ or the like is formed over the whole surface of the resistance layer 22 using chemical vapour deposition (CVD) techniques under a reduced pressure. Thereafter, the emitters 25 are formed via through-holes in the insulating layer on the resistance layer 22 as in the first embodiment described above.

The second embodiment is so constructed that the gates 26 and emitters 25 on the first substrate 20 are arranged as a matrix. Thus, it is merely necessary to deposit a single phosphor on the anode deposited over the whole of the inner surface of the second substrate when a monochromatic display is desired. Alternatively, three phosphors of red, green and blue luminous colours may be deposited on the anode is a desired pattern when a full-colour display is desired.

As can be seen from the foregoing, the image display device of the present invention is so constructed that the emitters each are provided in the recess of the substrate, resulting in the interval or distance between the emitter and the gate being determined in dependence upon the thickness of the emitter. Thus, the distance between both electrodes can be readily controlled by adjusting or varying the period of time during which the film for the emitter is formed, so that a micro-interval of the order of sub microns may be provided between the two components with high accuracy. Thus, it will be appreciated that the image display device of the present invention can be driven at a significantly reduced drive voltage but can exhibit a high display density.

Also, in the present invention, the emitters are each formed into a rectangular shape. Therefore, the emitters each exhibit increased electric field strength as compared with an emitter formed as a flat plate, so that in a device according to the present invention, the drive voltage can be further reduced. Also, the emitter of the present invention exhibits improved durability and emission uniformity as compared with an emitter provided with a triangle projection.

We claim:

1. An image display device comprising: a first insulating substrate formed with a plurality of recesses; a plurality of emitters provided in the recesses, each emitter being substantially rectangular in shape; a U-shaped gate provided at the periphery of each emitter on the first substrate; a second insulating, light transparent substrate forming a vacuum envelope in cooperation with the first substrate; and an anode phosphor combination lamined onto an inner surface of said second substrate at a position opposite to the emitters.

2. An image display device as claimed in claim 1 in which the emitter and gates are arranged as a matrix.

3. An image display device as claimed in claim 1 or 2 in which a single phosphor is deposited on the anode.

4. An image display device as claimed in claim 1 or 2, in which red, green and blue phosphors are deposited on the anode in a desired pattern.

5. An image display device as claimed in claim 1 or 2, wherein each emitter has a plurality of tooth elements at opposite side portions thereof, wherein said tooth elements are bounded by said U-shaped gate.

* * * * *